US006749474B2

(12) United States Patent
Hsu et al.

(10) Patent No.: US 6,749,474 B2
(45) Date of Patent: Jun. 15, 2004

(54) INFLATABLE FLOTATION DEVICE HAVING REMOVABLE CANOPY

(75) Inventors: Yaw-Yuan Hsu, Taipei (TW); Chin-Hsiang Pan, Taipei Hsien (TW); Kun Chao Hsu, Taipei (TW)

(73) Assignee: Intex Recreation Corp., Long Beach, CA (US)

( * ) Notice: Subject to any disclaimer, the term of this patent is extended or adjusted under 35 U.S.C. 154(b) by 31 days.

(21) Appl. No.: 10/153,319

(22) Filed: May 21, 2002

(65) Prior Publication Data

US 2003/0220032 A1 Nov. 27, 2003

(51) Int. Cl.[7] ..... B63C 9/08
(52) U.S. Cl. ..... 441/131
(58) Field of Search ..... 114/345, 361; 441/38, 40, 129, 130, 131, 132; D12/316; D21/803, 809

(56) References Cited

U.S. PATENT DOCUMENTS

| | | | | | |
|---|---|---|---|---|---|
| 1,764,852 | A | * | 6/1930 | Phillips | 441/131 |
| 2,854,014 | A | * | 9/1958 | Hasselquist | 52/2.19 |
| 3,054,124 | A | * | 9/1962 | Silverstone | 441/38 |
| 3,769,647 | A | | 11/1973 | Basa | |
| 3,883,913 | A | * | 5/1975 | Givens | 441/37 |
| 4,030,748 | A | | 6/1977 | Brock | |
| 4,799,910 | A | | 1/1989 | Kellough | |
| 4,865,381 | A | | 9/1989 | Van Rogue | |
| 5,190,194 | A | | 3/1993 | Rosner et al. | |
| 5,231,951 | A | * | 8/1993 | Tagar et al. | 114/345 |
| D343,220 | S | * | 1/1994 | Fireman | D21/803 |
| 5,299,588 | A | | 4/1994 | MacLeod | |
| 5,320,405 | A | | 6/1994 | Foster et al. | |
| 5,356,354 | A | | 10/1994 | Owens | |
| 5,394,822 | A | | 3/1995 | Worland | |
| 5,441,067 | A | | 8/1995 | James et al. | |
| 5,458,517 | A | | 10/1995 | Ellis | |
| 5,482,755 | A | | 1/1996 | Manning | |
| 5,690,133 | A | | 11/1997 | Capwell | |
| 5,718,612 | A | * | 2/1998 | Elsholz | 441/38 |
| 5,766,052 | A | * | 6/1998 | Metro et al. | 441/130 |
| 5,797,650 | A | | 8/1998 | Gonzalez, Jr. et al. | |
| 6,209,149 | B1 | * | 4/2001 | Song et al. | 4/498 |
| 6,209,150 | B1 | * | 4/2001 | Hsu et al. | 4/506 |
| 6,280,271 | B1 | * | 8/2001 | Peterson | 441/40 |

* cited by examiner

*Primary Examiner*—Andrew Wright
(74) *Attorney, Agent, or Firm*—Lewis, Brisbois, Bisgaard & Smith LLP

(57) ABSTRACT

An inflatable flotation device for use by persons in a swimming or wading pool includes an inflatable floating chamber for providing buoyancy in water. A bottom seat is provided for supporting a person. The bottom seat includes a pair of penetrations formed therein for enabling the person to extend their legs through the bottom seat. A pair of inflatable arches are removably attached to the inflatable floating chamber, and a canopy is affixed to the inflatable arches for blocking sunlight. At least one of the inflatable arches is removable from the inflatable floating chamber for facilitating entry into and exit from the inflatable floating chamber. An alternative embodiment of the inflatable flotation device having a removable canopy exhibits a construction in which the canopy is fully detachable from the inflatable floating chamber.

16 Claims, 11 Drawing Sheets

INFLATABLE FLOTATION DEVICE HAVING REMOVABLE CANOPY

BACKGROUND OF THE INVENTION

1. Technical Field

The present invention relates to flotation apparatus. More specifically, the present invention relates to methods and apparatus for an inflatable flotation device for use in a swimming or wading pool and having a removable canopy for facilitating entry into and exit from the flotation device.

2. Background Art

The prior art is directed to methods and apparatus for inflatable flotation devices having a canopy or awning employed for blocking direct sunlight.

Inflatable flotation devices intended for use by persons and comprised of inflatable plastic materials such as polyvinylchloride (hereinafter "PVC") sheeting and having, for example, an inflatable ring construction including appropriate air valves and a plastic bottom surface are known in the art. These inflatable flotation devices are typically employed in swimming and wading pools which contain water sufficient to enable the flotation device with a person seated therein to float on the water.

Likewise, devices intended to shade people from the direct rays of the sun are also known in the art. For example, several aquatic lounge and floatation devices have been known. These devices are designed to float within a larger body of water such as a swimming pool, pond, lake or the like. For example, one known device is an aquatic lounge having a pair of generally parallel, spaced-apart longitudinally extending buoyant members intended to float in a swimming pool or the like. The aquatic lounge includes a head rest having a small canopy for shading the face of an individual resting on the lounge. The shade canopy is attached to the head rest via a plurality of threaded mechanical fasteners. The aquatic lounge also includes a serving tray attachment having a small canopy positioned there over for protecting, for example, soft drinks from direct sun light on warm days.

Another known device is a recreational floating apparatus typically used by small children with the assistance of an adult. This device is also an aquatic floatation mechanism which includes a circular foamed plastic float, a supporting fabric seat and an attached frame collapsible canopy. The supporting seat is adapted to support a small child or infant in an upright position. The collapsible canopy is adapted to partially cover the person in the floating apparatus to provide protection from the sun. A third known device includes a similar floatation device which can serve as a seat and includes an umbrella shade mechanism positioned directly over the floatation portion of the device. Yet another similar device discloses an umbrella support for attachment to a recreation floatation device such as a large inter-tube-tube equipped with seats. The umbrella support includes a socket for mounting the support shaft of a sun shade umbrella therein.

Another device is characterized by an inflatable raft-like floatation device for use in, for example, a swimming pool. The raft-like device includes a series of communicating compartments wherein an outermost compartment pair is extendedly formed into a sun shade support. A sun shade having a fixed portion and an adjustable portion is affixed to the sun shade support. Another known device discloses a floating sun shield which has a rectangular floating frame and an arched sun shield canopy mounted over the rectangular floating frame. The floating frame can be comprised of polyvinylchloride and the sun shield canopy can be preferably formed of nylon fabric or similar materials. The arched portion of the canopy can include structural support rods. Many other sun shade type devices are also known in the art and are used typically with, for example, lounge chairs or the like. These sun shade type devices are also removable and replaceable but only via mechanical attachment means.

From the foregoing, it is clear that many flotation devices for use in a swimming pool or other water containing structure known in the prior art include a canopy or umbrella component intended to shade persons including children from the sun. However, an inflatable flotation device exhibiting a construction entirely comprised of polyvinylchloride sheeting and including an inflatable floating chamber having a bottom plastic seat including penetrations for a person's legs, and a pair of inflatable arches which form a canopy or awning over the person, the inflatable arches being conveniently removably attached to the inflatable floating chamber without any mechanical attachment means, has not been known.

Thus, there is a need in the art for an inflatable flotation device comprised entirely of polyvinylchloride sheeting and which includes an inflatable floating chamber having a bottom plastic seat including a pair of penetrations for extending a person's legs there through, and a pair of inflatable arches which form a canopy over the person where the inflatable arches including the canopy are conveniently removably attached or hinged for easy access to the inflatable floating chamber by hook and loop fasteners.

DISCLOSURE OF THE INVENTION

Briefly, and in general terms, the present invention provides a new and improved inflatable flotation device typically used by persons in a swimming or wading pool and having a removable canopy for facilitating entry into and exit from the flotation device. The feature of being able to withdraw the canopy positioned over an inflatable floating chamber greatly assists a person in entering and exiting the inflatable flotation device. It is noted that the present invention is intended for use by any individual in any age group including children under the care of a caretaker.

In a preferred embodiment, the inflatable flotation device can be fashioned from polyvinylchloride sheeting and includes an inflatable floating chamber. In a preferred embodiment, the inflatable floating chamber is illustrated as a circular ring shaped component. However, it is to be understood that the selection of the configuration for the inflatable floating chamber is merely exemplary and is not limited to a circular structure. The inflatable floating chamber can assume any of a plurality of configurations including any suitable inflatable surface of appropriate size and shape such as, for example, an inflatable raft having a rectangular, square, triangular, polygonal or other suitable shape. The inflatable floating chamber shown in the preferred embodiment illustrates a circular donut-shape and serves to provide buoyancy to the flotation device in water. In order to support the weight of a person, the inflatable floating chamber includes a bottom seat having a pair of penetrations formed therein. The penetrations serve to enable the person to pass their legs through the bottom seat so that the person can be comfortably positioned within the flotation device. This design also enables the person to stand upright in the pool.

Further, a pair of inflatable arches are affixed to a top surface of the inflatable floating chamber.

Each inflatable arch includes a forward terminal end and a rear terminal end. The rear terminal ends of the pair of inflatable arches can be permanently affixed as by Radio Frequency (RF) welding to the top surface of the inflatable floating chamber. Air is free to pass between the inflatable floating chamber and the pair of inflatable arches because of small holes formed in the top surface of the inflatable floating chamber at the location where the rear terminal ends of the inflatable arches are attached thereto. However, the forward terminal ends of the pair of inflatable arches are attached to the top surface of the inflatable floating chamber as with hook and loop fasteners, and are thus removable. In the alternative, cylindrical receiving wells could be mounted within the inflatable floating chamber for snugly and removably receiving the forward terminal ends of the inflatable arches. A canopy is affixed as by Radio Frequency (RF) welding to the top of each of the inflatable arches for preventing harsh sunlight from shining onto the skin of the person in the inflatable flotation device.

In the preferred embodiment, the forward terminal ends of the pair of inflatable arches and the canopy connected to the inflatable arches can be withdrawn (i.e., partially removed) from the top surface of the inflatable floating chamber. This can be accomplished by separating the hook and loop fasteners attached to (a) the forward terminal ends of the inflatable arches and (b) the top surface of the inflatable floating chamber. Likewise, the hook and loop fasteners can be reunited to reposition the canopy over the inflatable floating chamber. The canopy includes an inflatable tubular frame structure. However, the canopy can be modified to include a plurality of separate horizontal air chambers to facilitate structural integrity. Air inlet and exhaust valves are located in the bottom surface of the inflatable floating chamber and in the inflatable tubular frame structure of the canopy. Mounted on the top surface of the inflatable floating chamber is an inflatable back support for supporting the back of the person. In flotation devices specifically designed for children, a combination squeeze bar and whistle are also mounted to the top surface of the inflatable floating chamber for entertaining a child while seated therein.

The present invention is generally directed to an inflatable flotation device typically used by persons in a swimming or wading pool and having a removable canopy for facilitating entry into and exit from the flotation device. In its most fundamental embodiment, the inflatable flotation device includes an inflatable floating chamber for providing buoyancy in water. A bottom seat is provided for supporting a person. The bottom seat includes a pair of penetrations formed therein for enabling the person to extend their legs through the bottom seat. A pair of inflatable arches are removably attached to the inflatable floating chamber and a canopy is affixed to the inflatable arches for blocking sunlight. At least one of the inflatable arches is removable from the inflatable floating chamber for facilitating entry into and exit from the inflatable floating chamber.

An alternative embodiment of the inflatable flotation device having a removable canopy exhibits a construction in which the canopy is fully detachable from the inflatable floating chamber. In the alternative embodiment, the forward terminal ends and the rear terminal ends of each of the inflatable arches are attached to the top surface of the inflatable floating chamber as with hook and loop fasteners. In the alternative, cylindrical receiving wells could be mounted within the inflatable floating chamber for snugly and removably receiving the forward terminal ends and the rear terminal ends of the inflatable arches. Thus, both the forward terminal ends and the rear terminal ends of the inflatable arches are fully detachable from the top surface of the inflatable floating chamber. Further, a second air inlet and exhaust valve is positioned to inflate each of the inflatable arches and the inflatable cross-frame element of the canopy.

These and other objects and advantages of the present invention will become apparent from the following more detailed description, taken in conjunction with the accompanying drawings which illustrate the invention, by way of example.

DETAILED DESCRIPTION OF THE INVENTION

Figure 1:
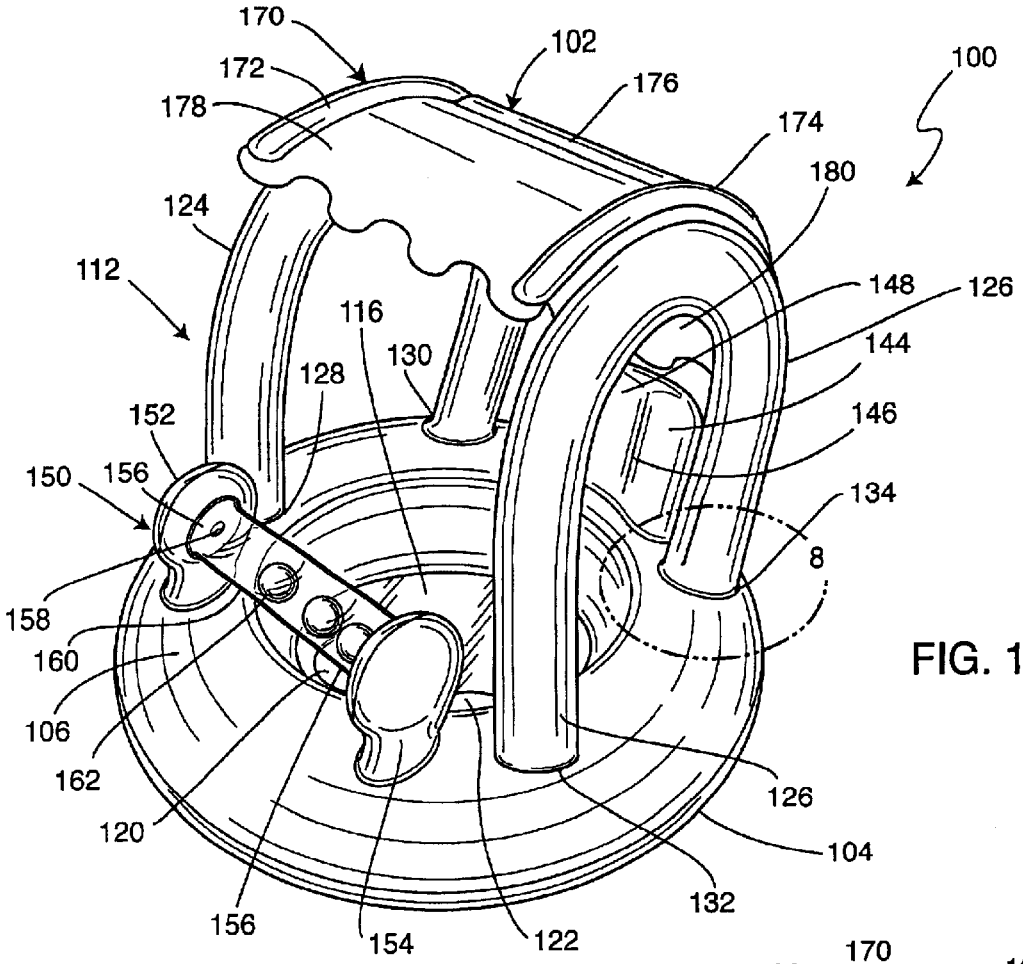
FIG. 1 is a perspective view of an inflatable flotation device having a partially removable canopy shown in the closed position and supported by a pair of inflatable arches positioned upon an inflatable floating chamber.
Figure 9:
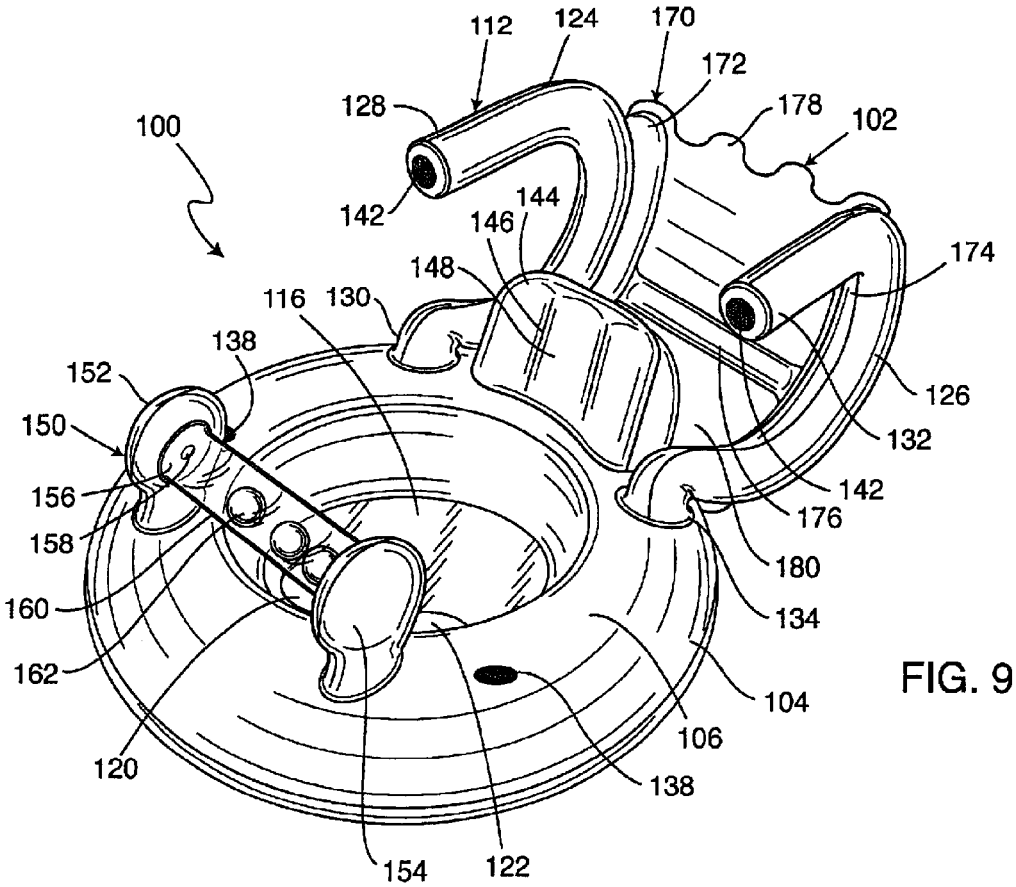
FIG. 9 is a perspective view of the inflatable flotation device of FIG. 1 with the partially removable canopy shown in the open position in that the pair of inflatable arches are withdrawn from a pair of forward hook and loop fasteners positioned on the inflatable floating chamber.
Figure 10:
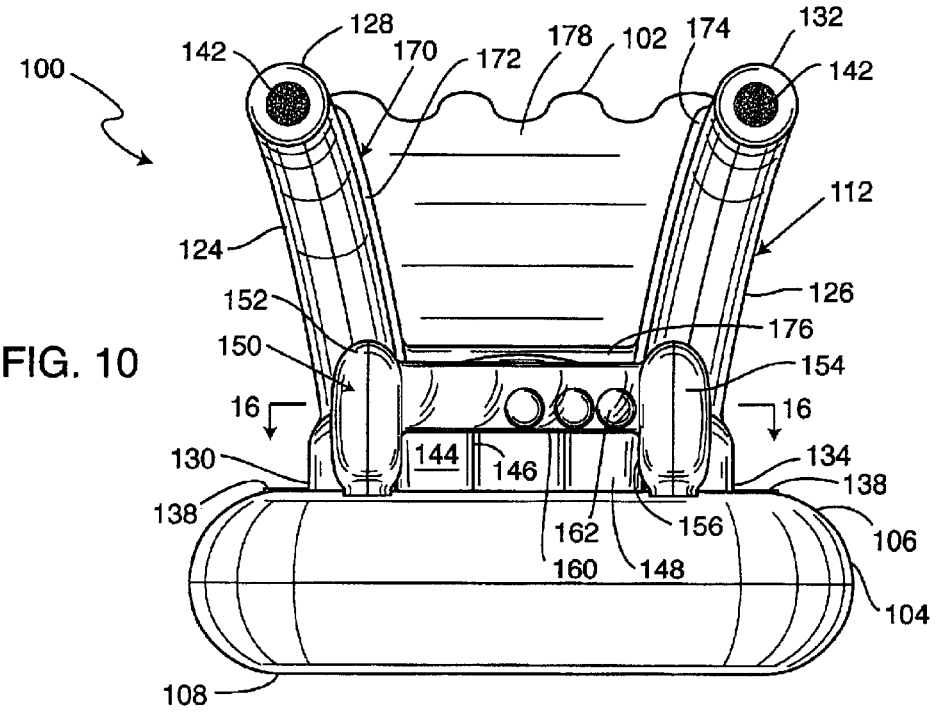
FIG. 10 is a front elevation of the inflatable flotation device of FIG. 1 with the partially removable canopy shown in the open position withdrawn from the inflatable floating chamber, and showing the forward hook and loop fasteners, fanciful squeeze bar and inflatable back support.
Figure 11:
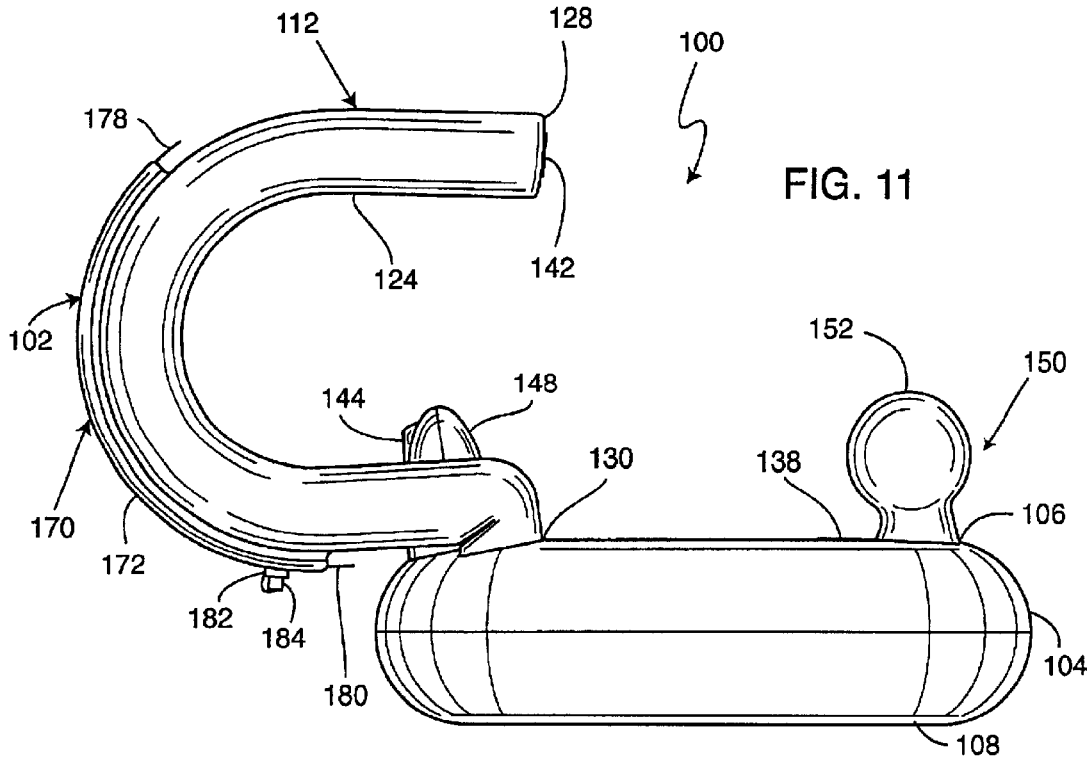
FIG. 11 is a left side elevation of the inflatable flotation device of FIG. 1 with the partially removable canopy shown in the open position withdrawn from the inflatable floating chamber, and showing the fanciful squeeze bar and the inflatable back support, each positioned upon the inflatable floating chamber.
Figure 12:
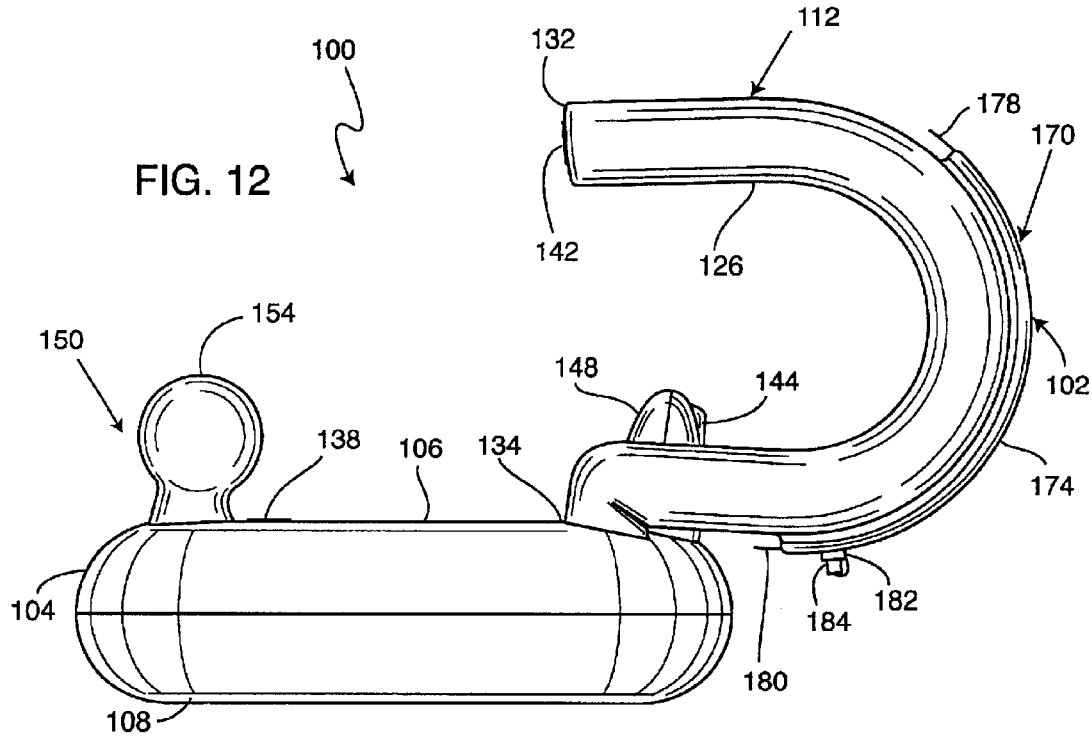
FIG. 12 is a right side elevation of the inflatable flotation device of FIG. 1 with the partially removable canopy shown in the open position withdrawn from the inflatable floating chamber, and showing the fanciful squeeze bar and the inflatable back support, each positioned upon the inflatable floating chamber.
Figure 13:
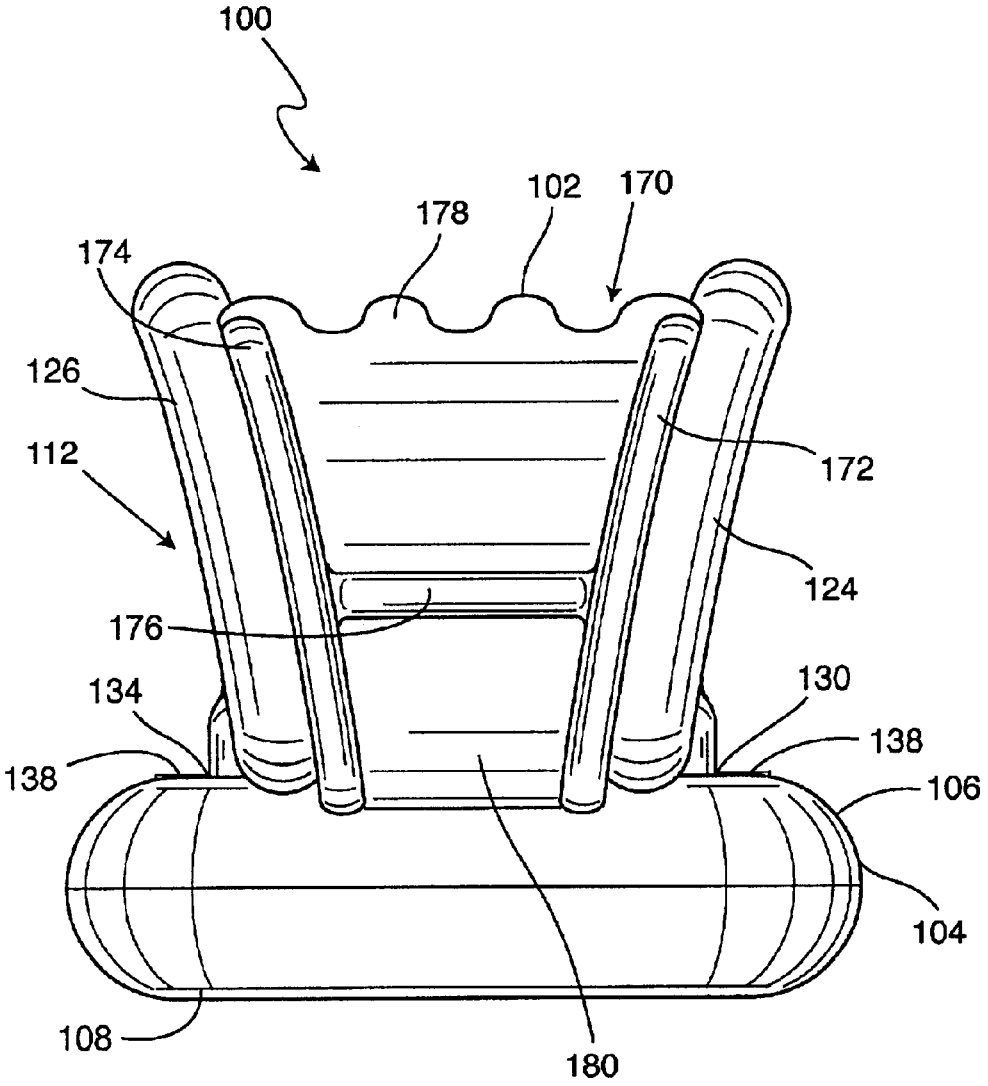
FIG. 13 is a rear elevation of the inflatable flotation device of FIG. 1 with the partially removable canopy shown in the open position withdrawn from the inflatable floating chamber, and showing the canopy mounted to the pair of inflatable arches.

The present invention is an inflatable flotation device 100 having a partially removable canopy 102 as shown in FIGS. 1 and 9 typically used by persons in a swimming or wading pool (not shown). The partially removable canopy 102 facilitates the entry into and exit from the inflatable flotation device 100. The inventive inflatable flotation device 100 can be and is typically comprised of polyvinylchloride (PVC) sheeting. The polyvinylchloride sheeting exhibits both strength for retaining air but yet comprises rounded, soft corners by design to avoid accidental injury to the person.

The flotation device 100 further includes an inflatable floating chamber 104 as is shown in FIGS. 1–5, 7 and 9–15 herein. In the preferred embodiment, the inflatable floating chamber 104 is illustrated as a circular ring-shaped component. However, it is to be understood that the selection of the configuration for the inflatable floating chamber 104 is merely exemplary and is not limited to a circular structure. The inflatable floating chamber 104 can assume any of a plurality of configurations including any suitable inflatable surface of appropriate size and shape such as, for example, an inflatable raft having a rectangular, square, triangular, polygonal or other suitable shape (not shown).

The inflatable floating chamber 104 shown in the preferred embodiment illustrates a circular donut-shape shown best in FIG. 9 and serves to provide buoyancy to the flotation device 100 in water. The inflatable floating chamber 104 includes a top surface 106 best shown in FIGS. 9 and 14 and likewise a bottom surface 108 best shown in FIGS. 7 and 15. The inflatable floating chamber 104 is the largest air cavity in the inventive inflatable flotation device 100. Thus, the inflatable floating chamber 104 includes a first air inlet and exhaust valve 110 mounted within the bottom surface 108. The first air inlet and exhaust valve 110 functions as a situs for the admission and exhaust of air into the inflatable floating chamber 104 and for a pair of inflatable arches 112 mounted to the top surface 106 of the inflatable floating chamber 104 as shown in FIG. 1 and discussed herein below. The first air inlet and exhaust valve 110 is comprised of polyvinylchloride material and is bonded to the polyvinylchloride sheeting of the bottom surface 108 as is known in the art, for example, by Radio Frequency (RF) welding.

In the present invention, sealing of the polyvinylchloride sheeting material can be accomplished by mechanical bonding which can include either the Radio Frequency (RF) sealing method or the Ultrasound sealing method, both well known in the art. In the RF sealing method (also referred to as dielectric sealing), radio frequency signals are utilized as a source of kinetic energy. In the Ultrasound sealing method (also referred to as sonic welding or sonic bonding), sound waves are employed as the source of kinetic energy. Notwithstanding which mechanical sealing method is employed in the appropriate bonding machinery, the kinetic energy is introduced to the portions of the polyvinylchloride sheeting to be sealed. The kinetic energy introduced into the polyvinylchloride sheeting results in the generation of internal heat in the sheeting. The generated heat results in a "weld" or "bond" of the sheets or pieces of polyvinylchloride. In both the RF sealing method and the Ultrasound sealing method, the parameter of pressure is added to the internal heating effect to assist in the bonding action. Either the RF sealing method or the Ultrasound sealing method is suitable for use, however, in the present invention, the RF sealing method, i.e., dielectric welding, is preferred.

Air can be injected into the inflatable floating chamber 104 and the pair of inflatable arches 112 at the first air inlet and exhaust valve 110 by any suitable air pump (not shown) or manually by the use of human lung power. Once the inflatable floating chamber 104 has been inflated to a pressure typically less than one pound per square inch (PSI), a first tethered stop plug 114 is employed to seal the first air inlet and exhaust valve 110. Additionally, the first air inlet and exhaust valve 110 functions as a situs for the discharge of air from the inflatable floating chamber 104. The pressurized air trapped within the inflatable floating chamber 104 and the pair of inflatable arches 112 can be ejected therefrom by removing the first tethered stop plug 114 from the first air inlet and exhaust valve 110. Hand pressure is then applied to the inflatable floating chamber 104 and to the pair of inflatable arches 112 until the trapped air is exhausted.

Figure 7:
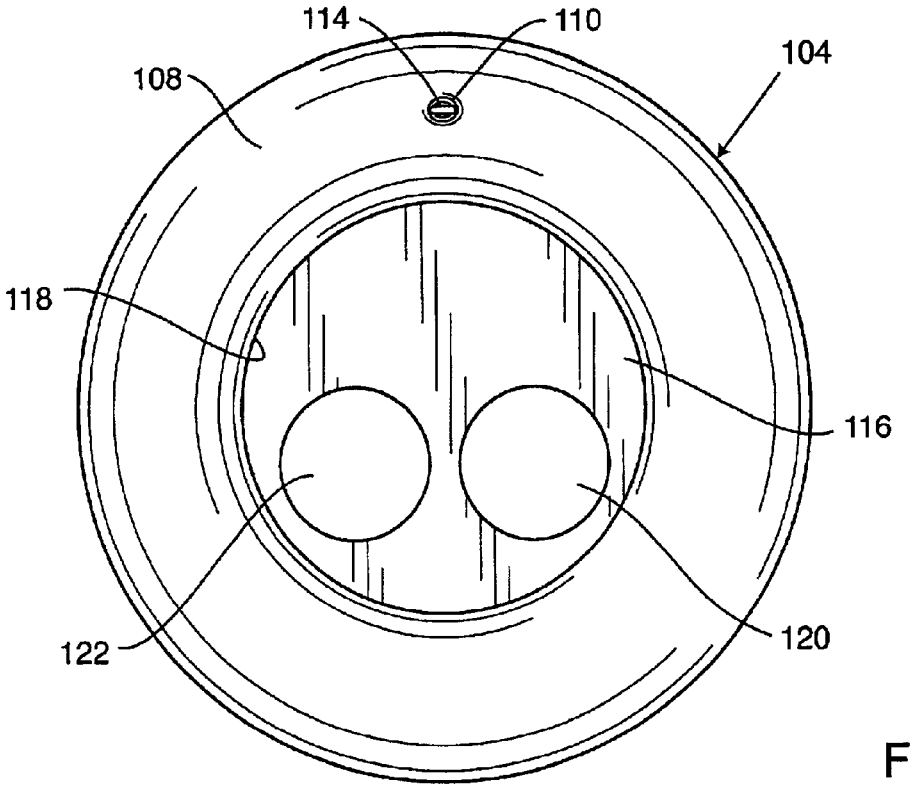
FIG. 7 is a bottom plan view of the inflatable flotation device of FIG. 1 showing a first air inlet and exhaust valve mounted within the inflatable floating chamber, and a pair of leg penetrations formed within the bottom seat positioned within the circumference of the inflatable floating chamber.
Figure 14:
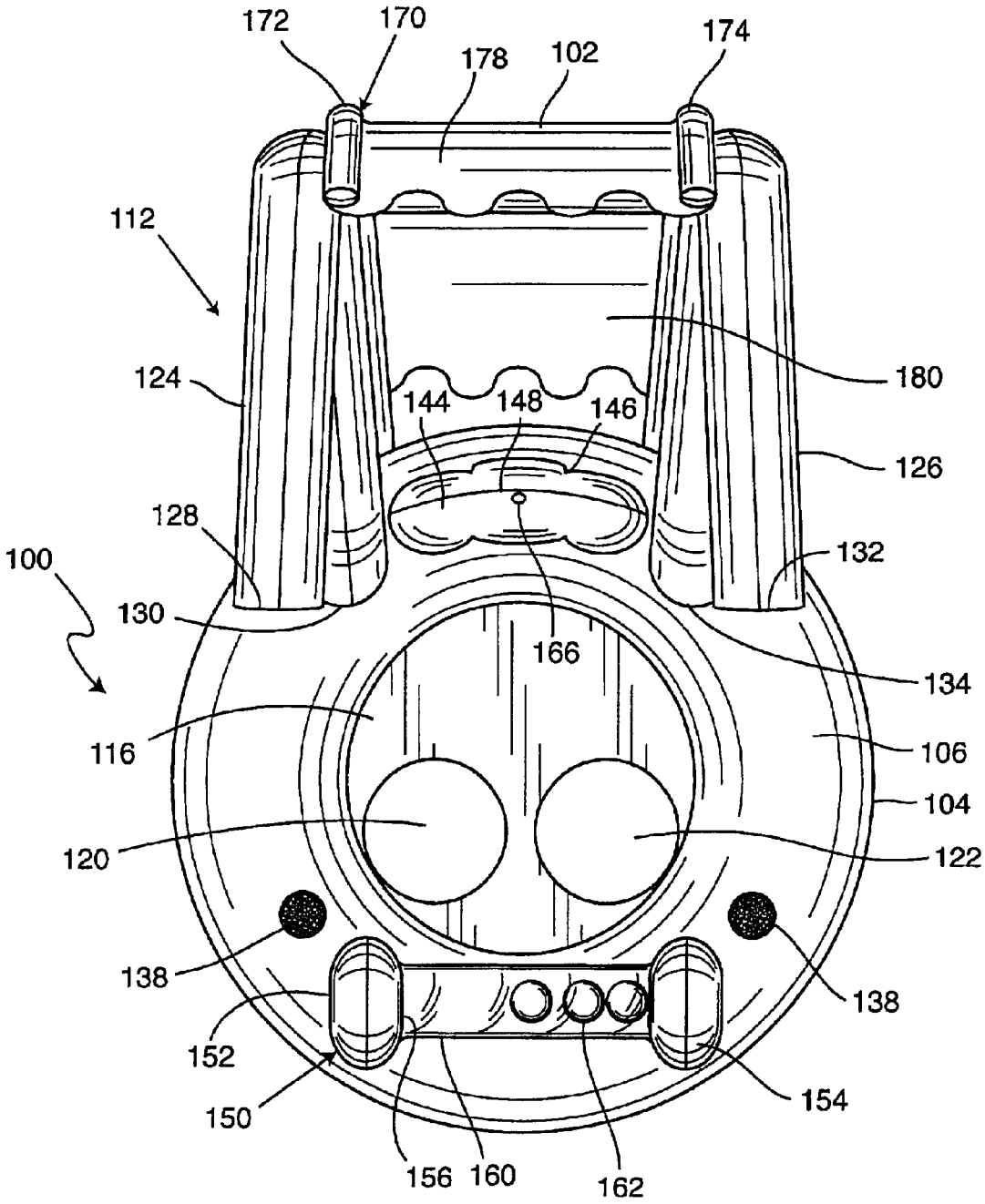
FIG. 14 is a top plan view of the inflatable flotation device of FIG. 1 with the partially removable canopy shown in the open position withdrawn from the inflatable floating chamber, and showing the squeeze bar and forward hook and loop fasteners, each positioned upon the inflatable floating chamber, and a bottom seat positioned within the circumference of the inflatable floating chamber.
Figure 15:
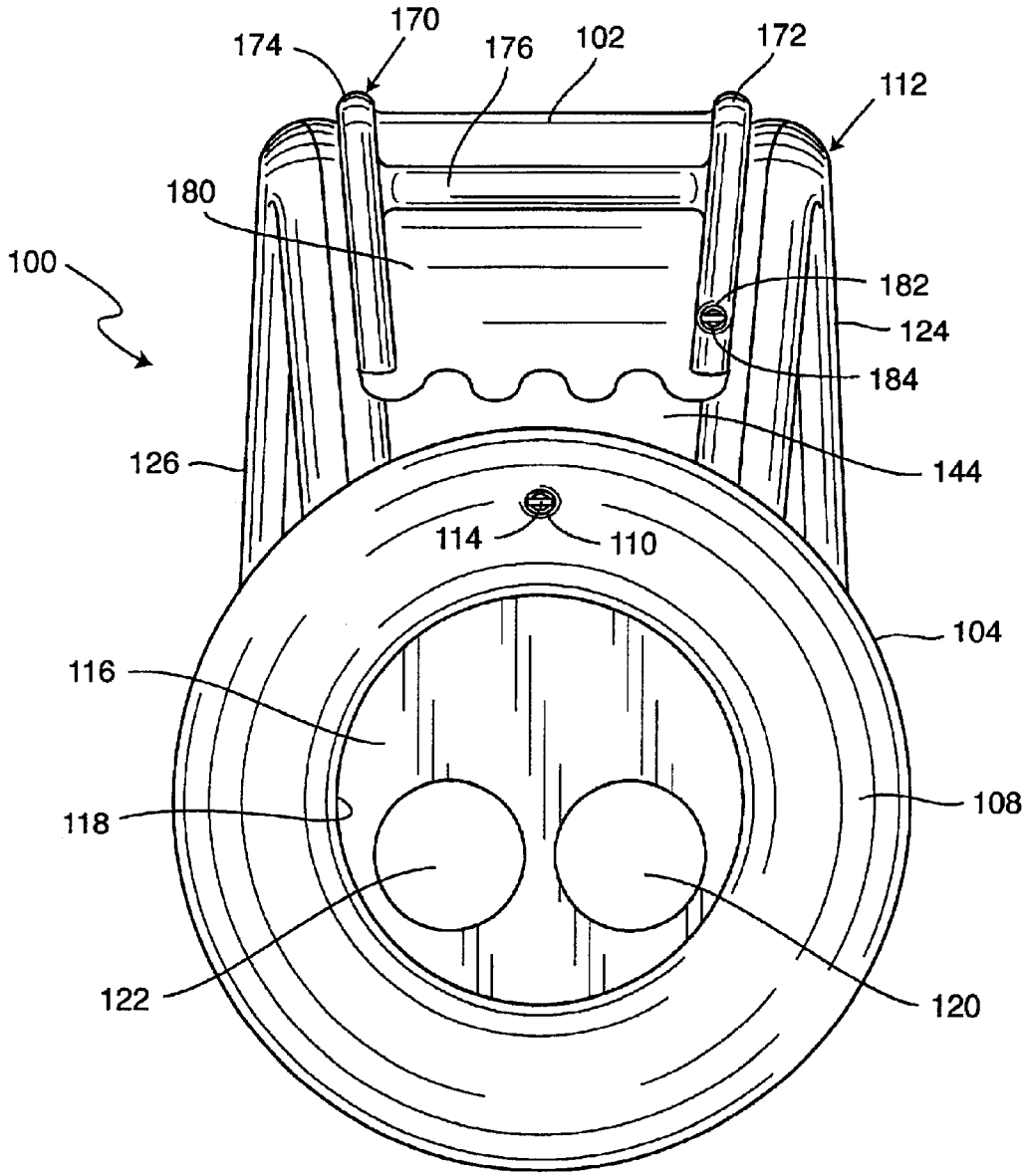
FIG. 15 is a bottom plan view of the inflatable flotation device of FIG. 1 with the partially removable canopy shown in the open position withdrawn from the inflatable floating chamber, and showing first and second air inlet and exhaust valves mounted within the inflatable floating chamber and the canopy, respectively, and a pair of leg penetrations formed within the bottom seat positioned within the circumference of the inflatable floating chamber.

In order to support the weight of a person (where the person can include a small child who can sit up confidently), the inflatable floating chamber 104 includes a bottom seat 116 best shown in FIG. 14 but also shown in FIGS. 1, 7, 9 and 15. The bottom seat 116 is also comprised of polyvinylchloride sheeting and is fused to the bottom surface 108 of the inflatable floating chamber 104 at a seal line 118 as shown in the bottom planar views of FIGS. 7 and 15. The process of fusing the bottom seat 116 to the bottom surface 108 of the inflatable floating chamber 104 can be accomplished by, for example, Radio Frequency (RF) welding as is known in the art. The bottom seat 116 includes a pair of penetrations 120 and 122 formed therein as is shown in FIGS. 7, 14 and 15. The penetrations 120 and 122 are sized and positioned in the bottom seat 116 for enabling the person to pass each of their legs through the bottom seat 116. This design enables the person to be comfortably positioned on the bottom seat 116 and to stand upright in the pool (not shown) which will keep the person above the maximum water level.

The pair of inflatable arches 112 are removably attached to the top surface 106 of the inflatable floating chamber 104 as shown in FIGS. 1–5. The pair of inflatable arches 112 is comprised of a first inflatable arch 124 and a second inflatable arch 126. The first inflatable arch 124 includes a first forward terminal end 128 and a first rear terminal end 130. The second inflatable arch 126 includes a second forward terminal end 132 and a second rear terminal end 134 as is best illustrated in FIGS. 1 and 9. The first rear terminal end 130 of the first inflatable arch 124 and the second rear terminal end 134 of the second inflatable arch 126 are permanently affixed to the top surface 106 of the inflatable floating chamber 104 by a suitable bonding method such as, for example, Radio Frequency (RF) welding. Thus, in the preferred embodiment, the first inflatable arch 124 and the second inflatable arch 126 of the pair of inflatable arches 112 always remain attached to the top surface 106 of the inflatable floating chamber 104 at the first rear terminal end 130 and the second rear terminal end 134, respectively. This is the case even when the canopy 102 and the pair of inflatable arches 112 are withdrawn. Thus, the canopy 102 is a partially removable canopy 102.

Attached to two locations on the top surface 106 of the inflatable floating chamber 104 is a loop portion 138 of a pair of hook and loop fasteners 140 shown best in FIGS. 9 and 14. Each of the loop portions 138 can be attached to the top surface 106 of the inflatable floating chamber 104 with an adhesive (not shown) or, in the alternative, by Radio Frequency (RF) welding. Likewise, the first forward terminal end 128 and the second forward terminal end 132 include a hook portion 142 of the pair of hook and loop fasteners 140 attached thereto best shown in FIGS. 9 and 10. The hook portions 142 can also be attached to the first forward terminal end 128 and the second forward terminal end 132 with an adhesive (not shown) or by Radio Frequency (RF) welding. Each loop portion 138 and hook portion 142 of the hook and loop fasteners 140 can have the appearance of a small patch and be utilized to enable the first forward terminal end 128 of the first inflatable arch 124 and the second forward terminal end 132 of the second inflatable arch 126 to be removed or withdrawn from the inflatable floating chamber 104. Since the canopy 102 is permanently attached to the pair of inflatable arches 112, then when the inflatable arches 112 (i.e., first inflatable arch 124 and second inflatable arch 126) are disconnected, removed or withdrawn from the top surface 106 of the inflatable floating chamber 104, the canopy 102 is likewise disconnected, partially removed or withdrawn.

Instead of utilizing the hook and loop fasteners 140 as described immediately above, cylindrical receiving wells (not shown) could be constructed or mounted within the inflatable floating chamber 104. For example, the cylindrical receiving wells (not shown) could be cup-shaped and mounted within the inflatable floating chamber 104 at the same locations as but in lieu of the loop portions 138 as shown in FIG. 9. (The loop portions 138 and the hook portions 142 of the hook and loop fasteners 140 would be deleted in the preferred embodiment.) Then, the first forward terminal end 128 and the second forward terminal end 132 would be snugly but removably received within the cup-shaped cylindrical receiving wells (not shown). This design would enable the first forward terminal end 128 of the first inflatable arch 124 and the second forward terminal end 132 of the second inflatable arch 126 to be removed from and subsequently reinserted into the cup-shaped cylindrical receiving wells (not shown) in the inflatable floating chamber 104 to facilitate removing the canopy 102.

Figure 5:
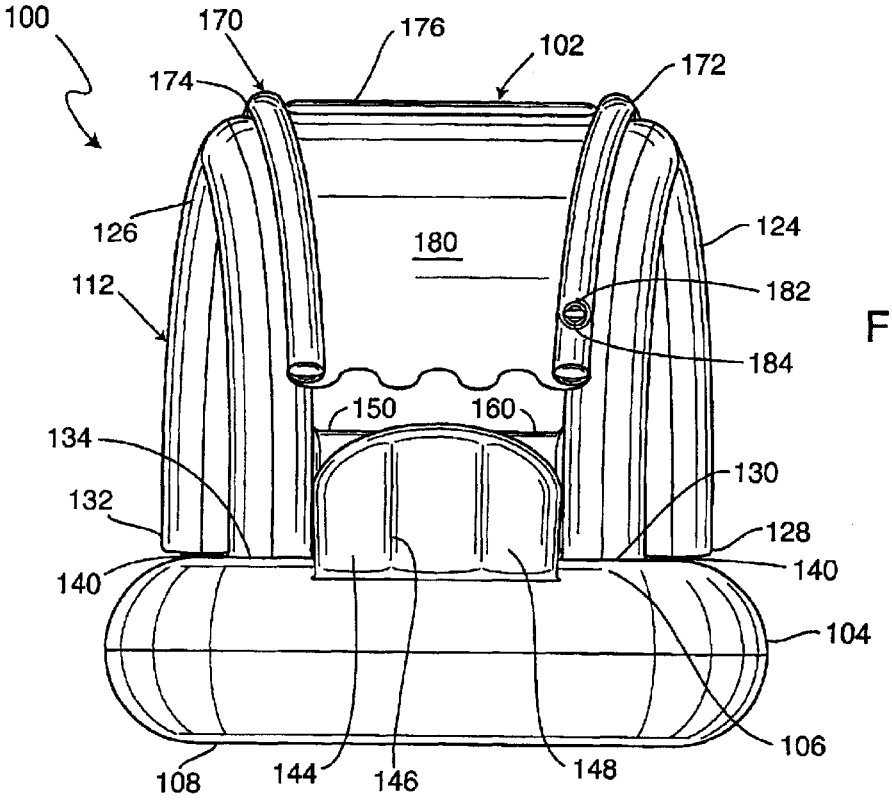
FIG. 5 is a rear elevation of the inflatable flotation device of FIG. 1 showing the partially removable canopy in the closed position and mounted on the pair of inflatable arches, and showing the inflatable back support, each positioned upon the inflatable floating chamber.

Also mounted to the top surface 106 of the inflatable floating chamber 104 is an inflatable back support 144 best shown in FIGS. 5 and 9 and also shown in FIGS. 1, 3, 4, 11 and 12. The inflatable back support 144 is also comprised of polyvinylchloride sheeting and is fused to the inflatable floating chamber 104 by any suitable method such as, for example, Radio Frequency (RF) welding. The function of the inflatable back support 144 is to provide back support to the person while in the seated position on the bottom seat 116 as can be seen clearly in FIGS. 9 and 14. The back support 144 is inflated with air to provide a cushioned effect and is positioned approximately midway between the first rear terminal end 130 of the first inflatable arch 124 and the second rear terminal end 134 of the second inflatable arch 126 as is clearly shown in FIG. 9. The inflatable back support 144 can include one or more vertical seams 146 to provide the effect of multiple cushions 148 as is best shown in FIG. 9.

The inflatable flotation device 100 is designed for the use of any person and thus it is intended that various models sized for a range of users will be available in the marketplace. In those models of the present invention designed for use by children, a combination squeeze bar and whistle 150 is mounted to the top surface 106 of the inflatable floating chamber 104 as shown in FIGS. 1–4, 6, 9–12 and 14. The squeeze bar and whistle 150 is an inflatable, colorful, fanciful device which serves to attract the attention of and to entertain a child while seated in the inflatable flotation device 100. Comprised of polyvinylchloride sheeting like each of the components of the inflatable flotation device 100, the squeeze bar and whistle 150 include a pair of inflatable vertical supports 152 and 154. The inflatable vertical supports 152 and 154 are sealed to the top surface 106 of the inflatable floating chamber 104 in any suitable manner such as, for example, Radio Frequency (RF) welding as is shown in FIGS. 1 and 9. Located on an inner face 156 of each of the inflatable vertical supports 152 and 154 is a small opening 158 clearly shown in FIG. 16. Positioned between and sealed to each of the inflatable vertical supports 152 and 154 is an inflatable crossbar 160 best shown in FIG. 16 but also shown in FIGS. 1, 2, 6, 9, 10 and 14.

Figure 16:
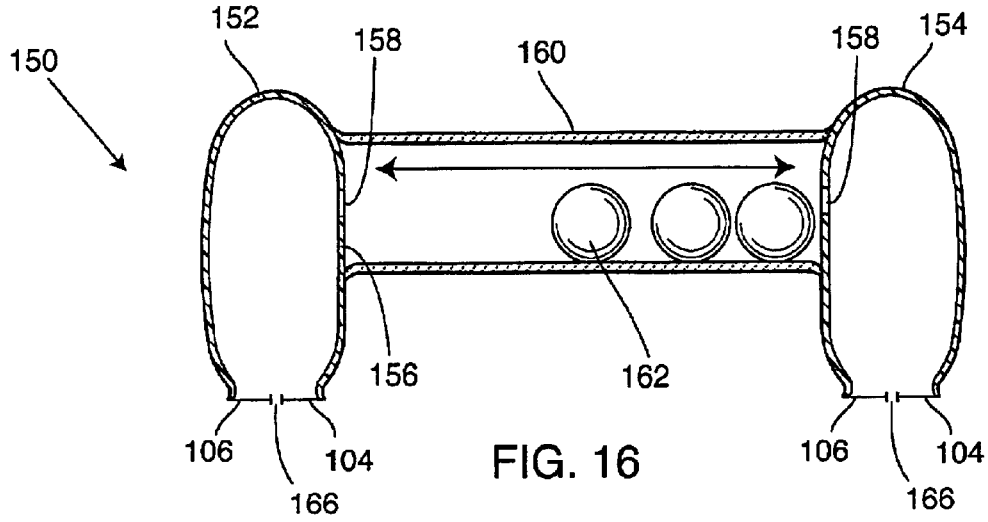
FIG. 16 is a cross-sectional view of the squeeze bar mounted on the inflatable floating chamber, taken along the line 16—16 of FIG. 10 and showing the construction thereof.

It is noted that the inflatable crossbar 160 is mounted over each of the small openings 158 formed in the inner faces 156 of the inflatable vertical supports 152 and 154. The small openings 158 enable the pair of inflatable vertical supports 152 and 154 and the inflatable crossbar 160 to form a single inflatable volume as shown in FIG. 16. Thus, upon squeezing any portion of the inflatable vertical supports 152, 154 or the inflatable crossbar 160, a fanciful squeeze noise is created. Additionally, the polyvinylchloride sheeting forming the inflatable crossbar 160 can be transparent. Positioned within the inflatable crossbar 160 is a plurality of colorful plastic balls 162 some of which can include jingling bells (not shown). Thus, the combination squeeze bar and whistle 150 is designed to generate a fanciful squeeze noise and jingling bell sounds to attract the attention of and entertain a child when the squeeze bar and whistle 150 is manipulated.

Each of (a) the pair of inflatable arches 112 comprised of the first inflatable arch 124 and the second inflatable arch 126, (b) the inflatable back support 144, and (c) the combination squeeze bar and whistle 150 has been described as being inflatable and fused to the top surface 106 of the inflatable floating chamber 104. The first air inlet and exhaust valve 110 is mounted in the bottom surface 108 of the inflatable floating chamber 104 as is shown clearly in FIG. 7. Thus, the only source of air for charging the pair of inflatable arches 112, inflatable back support 144, and combination squeeze bar and whistle 150 is the first air inlet and exhaust valve 110 via the inflatable floating chamber 104. In order to facilitate this air passage, a plurality of air passage openings 166 each fashioned as a small penetration is formed in the top surface 106 of the inflatable floating chamber 104.

Figure 8:
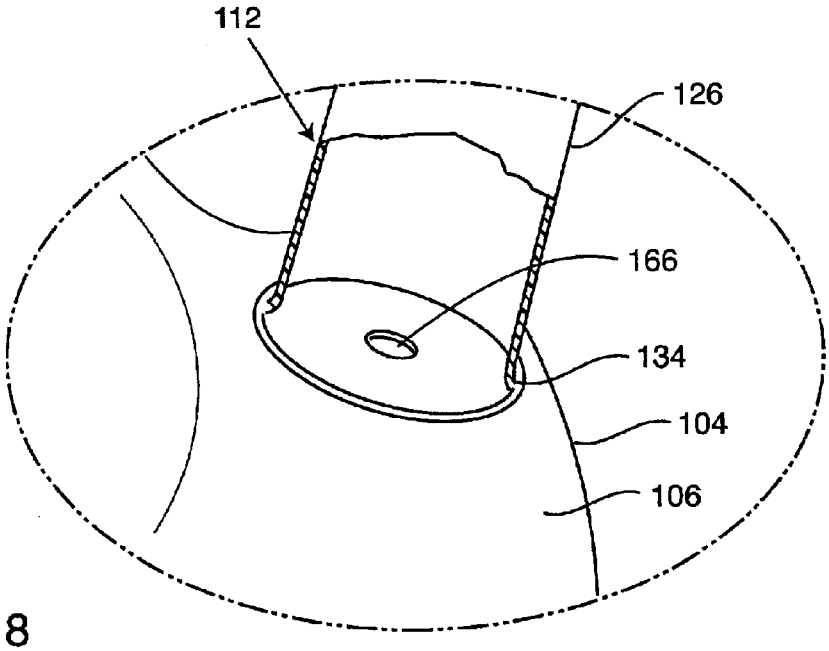
FIG. 8 is a detail drawing of an air channel located between the inflatable floating chamber and each of the corresponding inflatable arches for inflating the pair of inflatable arches.

Thus, one of the air passage openings 166 is formed in (1) the top surface 106 of the inflatable floating chamber 104 at the intersection with the second rear terminal end 134 of the second inflatable arch 126 as clearly shown in FIGS. 8 and 14. Likewise, one of the air passage openings 166 is also formed at the intersection of (2) the inflatable floating chamber 104 and the first rear terminal end 130 of the first inflatable arch 124, (3) the intersection of the inflatable floating chamber 104 and the inflatable back support 144, (4) the intersection of the inflatable floating chamber 104 and the inflatable vertical support 152 of the combination squeeze bar and whistle 150, and (5) the intersection of the inflatable floating chamber 104 and the inflatable vertical support 154 of the combination squeeze bar and whistle 150. In this manner, each of the inflatable arches 112 (i.e., first inflatable arch 124 and the second inflatable arch 126), inflatable back support 144, inflatable vertical supports 152, 154, and the inflatable crossbar 160 can be charged with air and subsequently exhausted through the first air inlet and exhaust valve 110.

Figure 2:
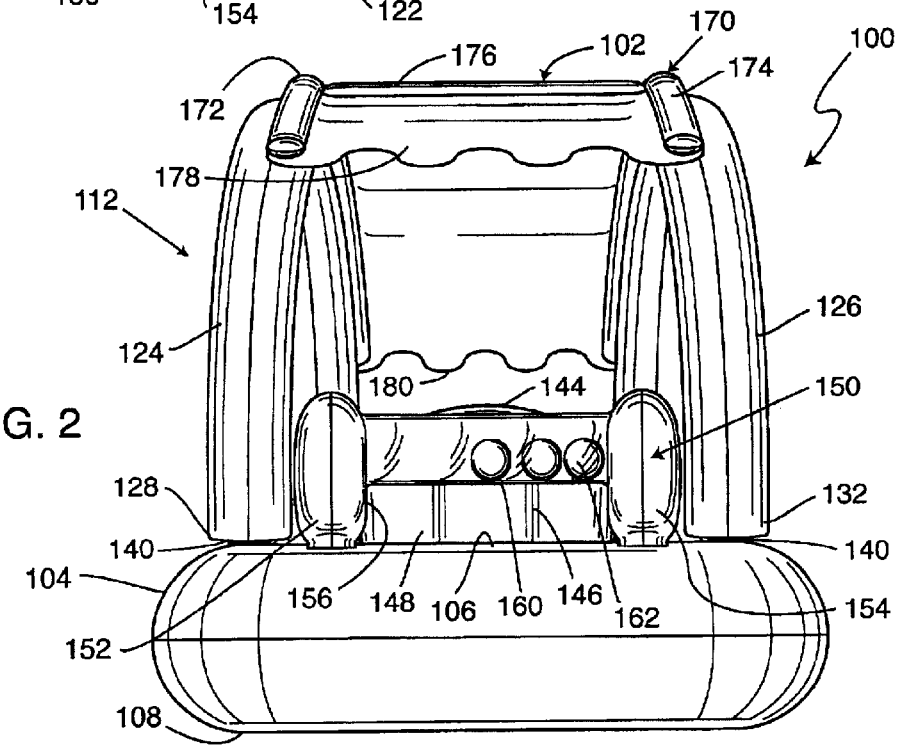
FIG. 2 is a front elevation of the inflatable flotation device of FIG. 1 showing the partially removable canopy shown in the closed position and mounted on the pair of inflatable arches and a fanciful squeeze bar and an inflatable back support, each positioned upon the inflatable floating chamber.
Figure 3:
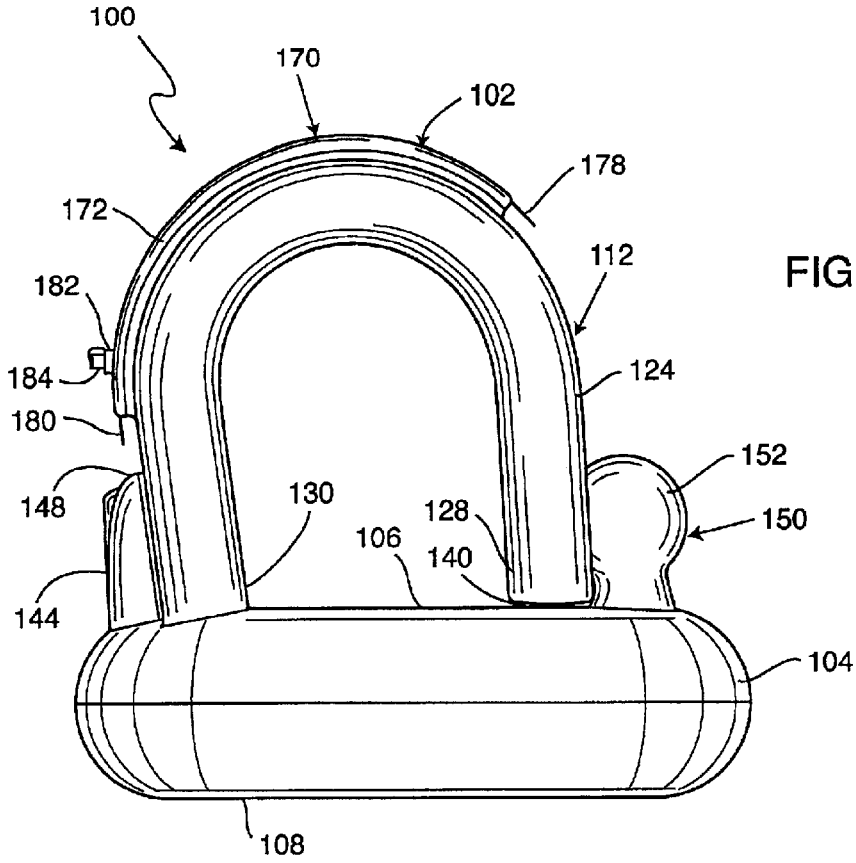
FIG. 3 is a left side elevation of the inflatable flotation device of FIG. 1 showing the partially removable canopy shown in the closed position, and an air inlet and exhaust valve each mounted on one of the pair of inflatable arches, and showing the fanciful squeeze bar and the inflatable back support, each positioned upon the inflatable floating chamber.
Figure 4:
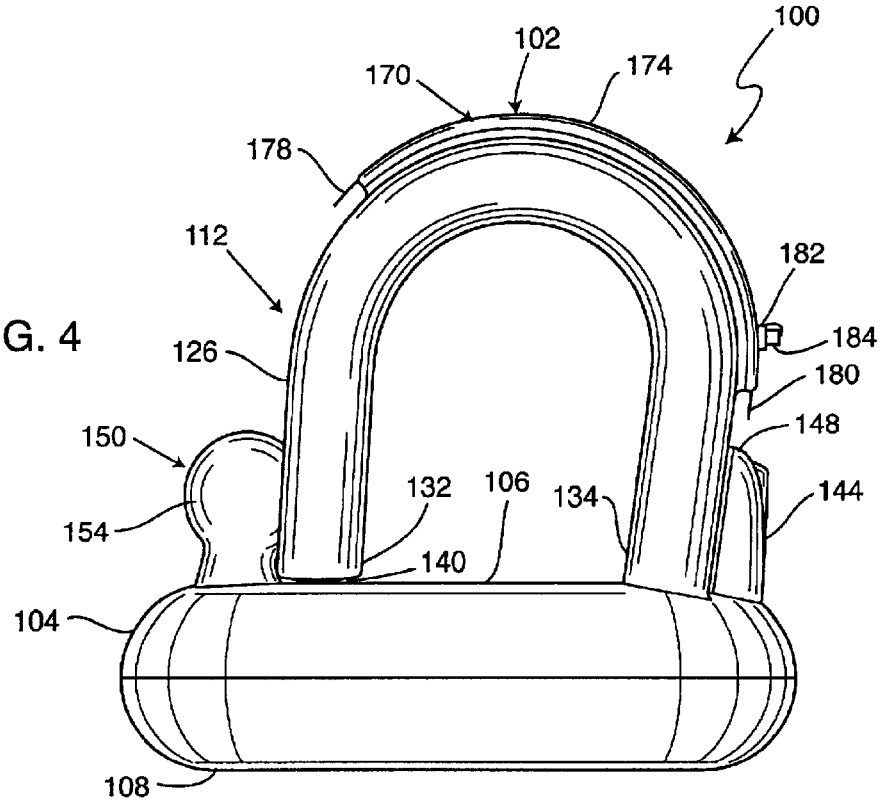
FIG. 4 is a right side elevation of the inflatable flotation device of FIG. 1 showing the partially removable canopy in the closed position and mounted on one of the pair of inflatable arches, and showing the fanciful squeeze bar and the inflatable back support, each positioned upon the inflatable floating chamber.
Figure 6:
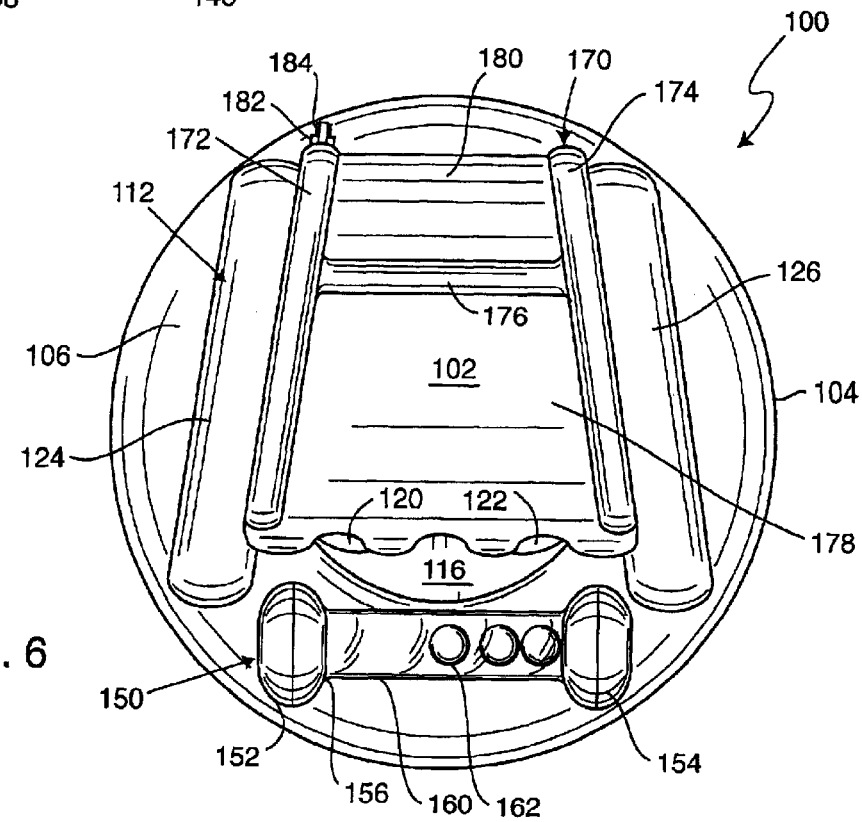
FIG. 6 is a top plan view of the inflatable flotation device of FIG. 1 showing the partially removable canopy in the closed position and mounted on the pair of inflatable arches, and showing the squeeze bar, each positioned upon the inflatable floating chamber and a bottom seat positioned within the circumference of the inflatable floating chamber.

The removable canopy 102 is also comprised of polyvinylchloride sheeting and is permanently attached to the pair of inflatable arches 112 as by, for example, Radio Frequency (RF) welding. The position of the partially removable canopy 102 above the pair of inflatable arches 112 and the inflatable floating chamber 104 prevents harsh sunlight from shining onto the skin of the person seated on the bottom seat 116. The partially removable canopy 102 includes an inflatable frame 170 having a first inflatable frame element 172, a second inflatable frame element 174 and an inflatable cross-frame element 176 shown best in FIGS. 1, 6 and 13. The first inflatable frame element 172 is permanently bonded to the first inflatable arch 124 as by, for example, Radio Frequency (RF) welding. The second inflatable frame element 174 is permanently bonded to the second inflatable arch 126 as by, for example, Radio Frequency (RF) welding. The inflatable cross-frame element 176 connects the first inflatable frame element 172 to the second inflatable frame element 174 as is clearly shown in FIGS. 6 and 13. A forward canopy cover 178 is connected between the first inflatable frame element 172, second inflatable frame element 174 and the inflatable cross-frame element 176 and is positioned over the front of the inflatable floating chamber 104 as shown in FIGS. 1, 2 and 6. A rear canopy cover 180 is also connected between the first inflatable frame element 172, second inflatable frame element 174 and inflatable cross-frame element 176 and is positioned over the rear of the inflatable floating chamber 104 as shown in FIGS. 5 and 6.

The inflatable frame 170 of the partially removable canopy 102 includes a second air inlet and exhaust valve 182 as is clearly shown in FIGS. 3, 4, 5, 6, 11, 12 and 15. The second air inlet and exhaust valve 182 is mounted within the first inflatable frame element 172 as is clearly shown in FIG. 3 and is dedicated to the inflation of the inflatable frame 170. Thus, the second air inlet and exhaust valve 182 functions as a situs for the admission and exhaust of air into the inflatable frame 170 as shown in FIG. 5. It is noted that the second air inlet and exhaust valve 182 is identical in construction and operation to the first air inlet and exhaust valve 110 mounted in the bottom of the inflatable floating chamber 104 as is shown in FIGS. 7 and 15. The second air inlet and exhaust valve 182 is comprised of polyvinylchloride material and is bonded to the polyvinylchloride sheeting of the first inflatable frame element 172 as is known in the art, for example, by Radio Frequency (RF) welding.

Air can be injected into the inflatable frame 170 at the second air inlet and exhaust valve 182 by any suitable air pump (not shown) or manually by the use of human lung power. Once the inflatable frame 170 has been inflated to a suitable pressure, a second tethered stop plug 184 is employed to seal the second air inlet and exhaust valve 182. The suitable air pressure for the inflatable frame 170 may vary depending upon the size of the person intended to use the inflatable flotation device 100. For example, in the child's version, a suitable air pressure is typically less than one pound per square inch (PSI). Additionally, the second air inlet and exhaust valve 182 functions as a situs for the discharge of air from the inflatable frame 170. The pressurized air trapped within the inflatable frame 170 can be ejected therefrom by removing the second tethered stop plug 184 from the second air inlet and exhaust valve 182. Hand pressure is then applied to the first inflatable frame element 172, second inflatable frame element 174 and inflatable cross-frame element 176 until the trapped air is exhausted.

Figure 17:
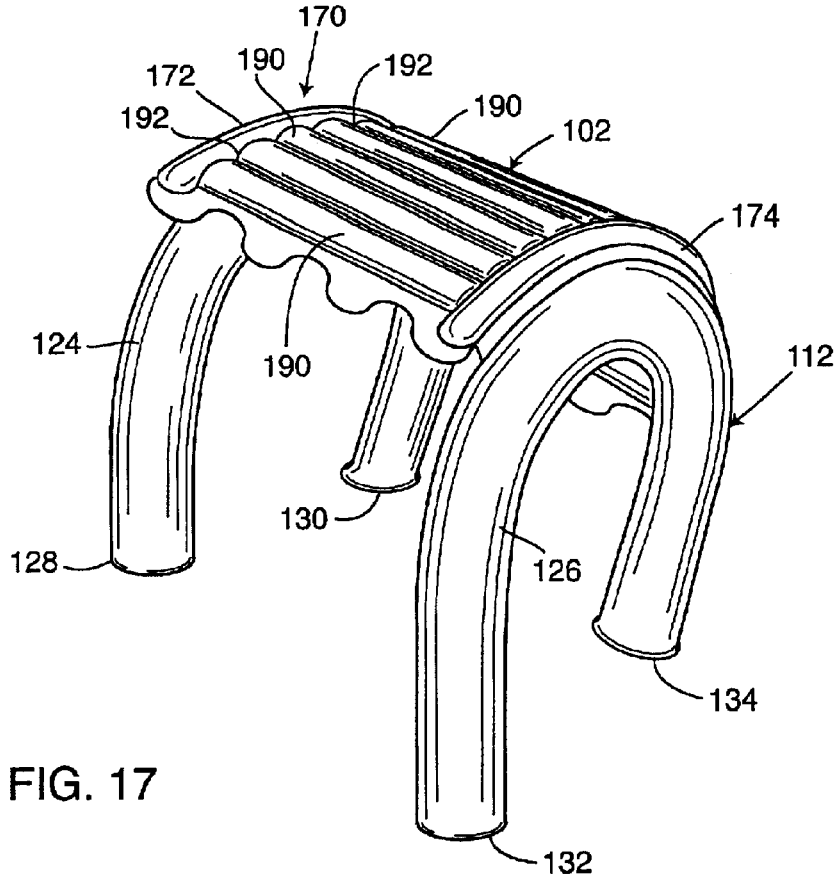
FIG. 17 is a perspective view of another canopy design of the inflatable flotation device of FIG. 1 wherein the partially removable canopy comprises a plurality of separate inflatable horizontal air chambers for facilitating structural integrity of the canopy.

Another form of the partially removable canopy 102 of the inflatable flotation device 100 is illustrated in FIG. 17. In this form, the partially removable canopy 102 continues to be comprised of polyvinylchloride sheeting and is still permanently attached to the pair of inflatable arches 112 as by, for example, Radio Frequency (RF) welding. The partially removable canopy 102 continues to include the inflatable frame 170 having the first inflatable frame element 172 and the second inflatable frame element 174 as shown in FIG. 17. The first inflatable frame element 172 is permanently bonded to the first inflatable arch 124 as by, for example, Radio Frequency (RF) welding. Likewise, the second inflatable frame element 174 is permanently bonded to the second inflatable arch 126 as by, for example, Radio Frequency (RF) welding. In the modification shown in FIG. 17, the partially removable canopy 102 includes a plurality of separate inflatable air chambers 190 where each of the separate air chambers 190 is positioned horizontally between the first inflatable frame element 172 and the second inflatable frame element 174. Each of the horizontally oriented, separate air chambers 190 is separated by one of a corresponding plurality of seams 192.

The structure of the partially removable canopy 102 shown in FIG. 17 is inflated in the same manner as previously described, i.e., by the second air inlet and exhaust valve 182 and the second tethered stop plug 184. The first inflatable frame element 172 of the inflatable frame 170 continues to carry the second air inlet and exhaust valve 182 and corresponding second tethered stop plug 184. The canopy 102 shown in FIG. 17 combines the horizontally oriented, separate air chambers 190 with the seams 192 to facilitate the structural integrity and the removal, i.e., the withdrawal, of the partially removable canopy 102. In the absence of the horizontally oriented, separate air chambers 190 and the associated seams 192, the partially inflated canopy 102 would be stiff and unmanageable. The construction disclosed in FIG. 17 facilitates folding, withdrawing and partially removing of the canopy 102 and also facilitates structural design and integrity.

Notwithstanding which form of the partially removable canopy 102 is utilized, the operation of the inflatable floatation device 100 remains the same. During use, the inflatable floating chamber 104 is inflated to the appropriate air pressure (which in the child's version is typically less than one pound per square inch but certainly less than five pounds per square inch). Air is injected through the first air inlet and exhaust valve 110 and sealed with the first tethered stop plug 114. This step charges the inflatable floating chamber 104, pair of inflatable arches 112, inflatable back support 144, and combination squeeze bar and whistle 150. Likewise, air is injected through the second air inlet and exhaust valve 182 to charge the inflatable frame 170 which is then sealed with the second tethered stop plug 184. The inflatable floatation device 100 is then positioned in the appropriate depth of water in the swimming or wading pool.

In order to facilitate the entry and exit of the person utilizing the inflatable flotation device 100, the partially removable canopy 102 is removed, i.e., withdrawn. This is accomplished by separating the hook portions 142 (attached to each of the forward terminal ends 128 and 132 of the first and second inflatable arches 124 and 126) from the loop portions 138 (affixed to the top surface 106 of the inflatable floating chamber 104) of the hook and loop fasteners 140 best shown in FIG. 9. Once this is accomplished, the partially removable canopy 102 can be withdrawn, and the person can be positioned onto the bottom seat 116. It is to be emphasized that either (a) the first forward terminal end 128 or the second forward terminal end 132, or (b) both the first forward terminal end 128 and the second forward terminal end 132 can be removed from the inflatable floating chamber 104 to facilitate the partial removal of the canopy 102. Thus, at least one of the inflatable arches 124 or 126 having the corresponding first forward terminal end 128 and corresponding second forward terminal end 132, respectively, must be removed from the inflatable floating chamber 104 to facilitate entry into and exit from the bottom seat 116 of the inflatable floating chamber 104.

The partially removable canopy 102 can then be reassembled by reattaching the hook and loop fasteners 140 so that the canopy 102 protects the person from the harsh sunlight. The reattaching requires that the hook portion 142 of the first forward terminal end 128 of the first inflatable arch 124 and the hook portion 142 of the second forward terminal end 132 of the second inflatable arch 126 be connected to the corresponding loop portions 138 of the hook and loop fasteners 140 affixed to the top surface 106 of the inflatable floating chamber 104. The partial removal, i.e., withdrawal, of the canopy 102 is then repeated to enable the person to exit the inflatable flotation device 100. To disassemble the inflatable flotation device 100, the first tethered stop plug 114 is removed from the first air inlet and exhaust valve 110 and the second tethered stop plug 184 is removed from the second air inlet and exhaust valve 182. Air can then be forced out of the inflatable flotation device 100 through the valves 110 and 182 by manual manipulation.

Figure 18:
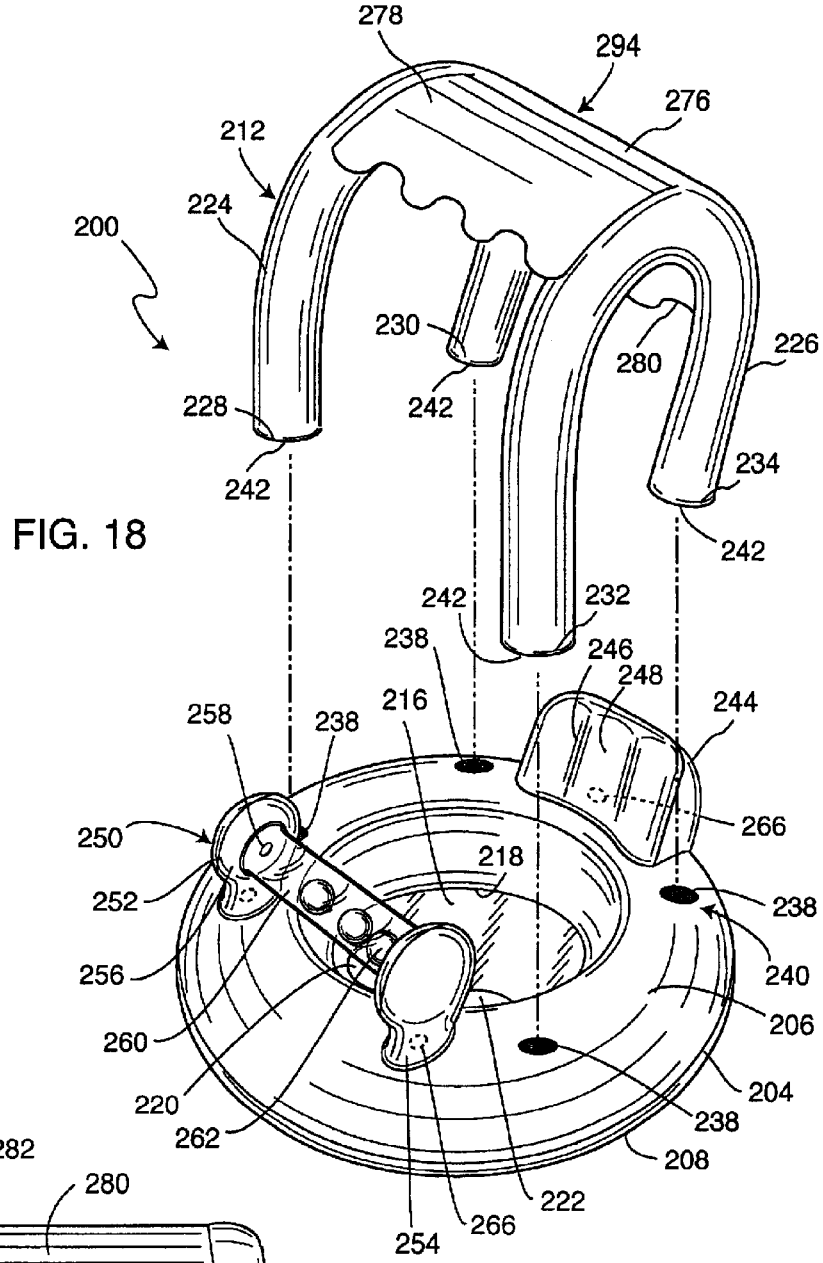
FIG. 18 is an exploded perspective view of a first alternative embodiment of an inflatable flotation device having a removable canopy and showing the canopy fully detached from the inflatable floating chamber.
Figure 19:
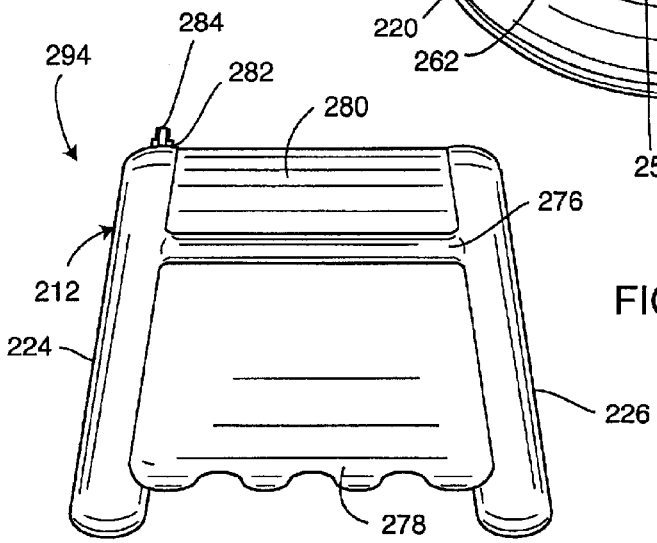
FIG. 19 is a top plan view of the fully detached canopy of the inflatable flotation device of FIG. 18 showing first and second inflatable arches in combination with an inflatable cross-frame element for supporting forward and rear canopy covers and showing a second air inlet and exhaust valve.

An alternative embodiment of the inflatable flotation device having a removable canopy of the present invention is shown in FIGS. 18–19 and is referred to by the identification number 200. Each of the components appearing in the alternative embodiment 200 that correspond in structure and function to those components appearing in the preferred embodiment 100 is identified by the corresponding number of the 200 series.

The main structural modification appearing in the alternative embodiment 200 of the present invention is directed to a removable canopy 294 which is fully detachable from an inflatable floating chamber 204 as shown in FIG. 18. In the alternative embodiment 200 (as with the preferred embodiment 100), the inflatable floating chamber 204 is illustrated as a circular ring-shaped component. However, it is to be understood that the selection of the configuration for the inflatable floating chamber 204 is merely exemplary and is not limited to a circular structure. The inflatable floating chamber 204 can assume any of a plurality of configurations including any suitable inflatable surface of appropriate size and shape such as, for example, an inflatable raft having a rectangular, square, triangular, polygonal or other suitable shape (not shown).

The main components of the inflatable flotation device 200 include most of the same components having the identical function as disclosed in the preferred embodiment 100 including the inflatable floating chamber 204. The inflatable floating chamber 204 shown in the alternative embodiment 200 illustrates a circular donut-shape and serves to provide buoyancy to the flotation device 200 in water. The inflatable floating chamber 204 is comprised of polyvinylchloride sheeting and includes a top surface 206 shown in FIG. 18 and a bottom surface 208. A first air inlet and exhaust valve 210 comprised of polyvinylchloride materials (not shown but identical to the first air inlet and exhaust valve 110 shown in FIG. 7 of the preferred embodiment) is mounted within the bottom surface 208 and serves as a situs for admission and exhaust of air into the inflatable floating chamber 204. The first air inlet and exhaust valve 210 is comprised of polyvinylchloride materials and is bonded to the polyvinylchloride sheeting of the bottom surface 208 by, for example, Radio Frequency (RF) welding. Once air has been injected into the inflatable floating chamber 204 by a suitable air source (not shown), a first tethered stop plug 214 (not shown but identical to the first tethered stop plug 114 shown in FIG. 7 of the preferred embodiment) is utilized to seal the first air inlet and exhaust valve 210. Removal of the first tethered stop plug 214 and manual manipulation of the inflatable floating chamber 204 is sufficient to eject the trapped air therefrom.

The inflatable floating chamber 204 includes a bottom seat 216 as shown in FIG. 18. The bottom seat 216 is comprised of polyvinylchloride sheeting and is fused as by Radio Frequency (RF) welding to the bottom surface 208 of the inflatable floating chamber 204 at a seal line 218. The bottom seat 216 includes a pair of penetrations 220 and 222 formed therein and sized to enable the person seated in the bottom seat 216 to extend their legs there through. This design facilitates comfortable seating on the bottom seat 216 and standing by the person in the pool (not shown) depending upon the maximum water level.

The inflatable flotation device 200 also includes a pair of inflatable arches 212. The inflatable arches 212 are removably attached to the top surface 206 of the inflatable floating chamber 104 and include a first inflatable arch 224 and a second inflatable arch 226 as shown in FIG. 18. The first inflatable arch 224 includes a first forward terminal end 228 and a first rear terminal end 230 while the second inflatable arch 226 includes a second forward terminal end 232 and a second rear terminal end 234. It is noted that the first forward terminal end 228 and the first rear terminal end 230 of the first inflatable arch 224 and also the second forward terminal end 232 and the second rear terminal end 234 of the second inflatable arch 226 are all detachably connected to the top surface 206 of the inflatable floating chamber 204.

Attached to four locations on the top surface 206 of the inflatable floating chamber 204 is a loop portion 238 of a set of four hook and loop fasteners 240 shown in FIG. 18. The loop portions 238 can be attached to the top surface 206 of the inflatable floating chamber 204 with an adhesive (not shown) or by Radio Frequency (RF) welding. Likewise, the first forward terminal end 228 and first rear terminal end 230 of the first inflatable arch 224 and the second forward terminal end 232 and the second rear terminal end 234 of the second inflatable arch 226 include a hook portion 242 of the set of four hook and loop fasteners 240. The hook portions 242 can also be attached to the first forward terminal end 228, first rear terminal end 230, second forward terminal end 232 and the second rear terminal end 234 with an adhesive (not shown) or by Radio Frequency (RF) welding. Each loop portion 238 and hook portion 242 of the hook and loop fasteners 240 can appear as a small patch on the top surface 206 of the inflatable floating chamber 204. The hook and loop fasteners 240 are utilized for enabling the first forward terminal end 228 and first rear terminal end 230 of the inflatable arch 224, and the second forward terminal end 232 and the second rear terminal end 234 of the inflatable arch 226 to be detachably removed from the inflatable floating chamber 204.

Instead of utilizing the hook and loop fasteners 240 as described immediately above, cylindrical receiving wells (not shown) could be constructed or mounted within the inflatable floating chamber 204. For example, the cylindrical receiving wells (not shown) could be cup-shaped and mounted within the inflatable floating chamber 204 at the same locations as but in lieu of the loop portions 238 as shown in FIG. 18. (The loop portions 238 and the hook portions 242 of the hook and loop fasteners 240 would be deleted in the alternative embodiment of FIGS. 18 and 19.) Then, the first forward terminal end 228, first rear terminal end 230, second forward terminal end 232 and second rear terminal end 234 would be snugly but removably received within the cup-shaped cylindrical receiving wells (not shown). This design would enable (a) the first forward terminal end 228 and the first rear terminal end 230 of the first inflatable arch 224, and (b) the second forward terminal end 232 and the second rear terminal end 234 of the second inflatable arch 226 to be removed from and subsequently reinserted into the cup-shaped cylindrical receiving wells (not shown) in the inflatable floating chamber 204 for facilitating the removal of the detachable canopy 294.

An inflatable back support 244 is mounted to the top surface 206 of the inflatable floating chamber 204 as shown in FIG. 18. The inflatable back support 244 is comprised of polyvinylchloride sheeting which is fused to the inflatable floating chamber 204 by, for example, Radio Frequency (RF) welding. The inflatable back support 244 provides back support to the person while in the seated position on the bottom seat 216 as shown in FIG. 18. The back support 244 is inflated with air supplied from the inflatable floating chamber 204 (discussed herein below) to provide a cushioned effect and is positioned midway between the first rear terminal end 230 of the first inflatable arch 224 and the second rear terminal end 234 of the second inflatable arch 226. The inflatable back support 244 can include one or more vertical seams 246 to provide the effect of multiple cushions 248.

Both embodiments of the inflatable flotation device (100, 200) are designed for the use of any person and thus it is intended that various models sized for a range of users will be available in the marketplace. In those models of the present invention designed for use by children, a combination squeeze bar and whistle 250 is mounted to the top surface 206 of the inflatable floating chamber 204 as shown in FIG. 18. The squeeze bar and whistle 250 is an inflatable, colorful, fanciful device which serves to attract the attention of and to entertain the child while seated on the bottom seat 216. Comprised of polyvinylchloride sheeting, the squeeze bar and whistle 250 includes a pair of vertical supports 252 and 254. The vertical supports 252 and 254 are sealed to the top surface 206 of the inflatable floating chamber 204 by, for example, Radio Frequency (RF) welding. Located on an inner face 256 of each of the inflatable vertical supports 252 and 254 is a small opening 258. Positioned between and sealed to each of the inflatable vertical supports 252 and 254 is an inflatable crossbar 260.

The inflatable crossbar 260 is mounted over each of the small openings 258 formed on the inner face 256 of each of the inflatable vertical supports 252 and 254. The small openings 258 enable the pair of inflatable vertical supports 252 and 254 and the inflatable crossbar 260 to form a single volume. Upon squeezing any portion of the inflatable vertical supports 252, 254 or the inflatable crossbar 260, a fanciful noise is created. The polyvinylchloride sheeting forming the inflatable crossbar 260 can be transparent. Positioned within the inflatable crossbar 260 is plurality of colorful plastic balls 262 some of which include jingle bells (not shown). Thus the combination squeeze bar and whistle 250 is designed to generate a fanciful squeeze noise and jingling sounds to attract the attention of and to entertain the child when the squeeze bar and whistle 250 is manipulated.

Both the inflatable back support 244 and the combination squeeze bar and whistle 250 are inflatable and fused to the top surface 206 of the inflatable floating chamber 204. The only source of air for charging the inflatable floating chamber 204 is the first air inlet and exhaust valve 210 mounted in the bottom surface 208 of the inflatable floating chamber 204. Thus, the first air inlet and exhaust valve 210 also serves to provide the air necessary to charge the inflatable back support 244 and the combination squeeze bar and whistle 250. In order to facilitate this air passage, a plurality of air passage openings 266 each fashioned as a small penetration is formed in the top surface 206 of the inflatable floating chamber 204. Thus, one of the air passage openings 266 is formed at the intersection of (1) the top surface 206 of the inflatable floating chamber 204 and the inflatable back support 244, (2) the top surface 206 of the inflatable floating chamber 204 and the inflatable vertical support 252 of the combination squeeze bar and whistle 250, and (3) the top surface 206 of the inflatable floating chamber 204 and the inflatable vertical support 254 of the combination squeeze bar and whistle 250. In this manner, the inflatable back support 244, the inflatable vertical supports 252, 254, and the inflatable crossbar 260 can each be charged with air and subsequently exhausted through the first air inlet and exhaust valve 210.

The removable canopy 294 is also comprised of polyvinylchloride sheeting and is permanently attached to the pair of inflatable arches 212 as by, for example, Radio Frequency (RF) welding as shown in FIGS. 18 and 19. The position of the removable canopy 294 above the pair of inflatable arches 212 and the inflatable floating chamber 204 prevents harsh sunlight from shining onto the person positioned on the bottom seat 216. The removable canopy 294 is suspended between and permanently bonded to the first inflatable arch 224 and the second inflatable arch 226 as is best shown in FIG. 19. Extending horizontally across the removable canopy 294 between the first inflatable arch 224 and the second inflatable arch 226 is an inflatable cross element 276. The inflatable cross element 276 is permanently bonded to the first inflatable arch 224 and the second inflatable arch 226 so that the inflatable cross element 276 permanently connects the first inflatable arch 224 to the second inflatable arch 226. It is further noted that the first inflatable arch 224, the second inflatable arch 226 and the inflatable cross element 276 form a common air chamber. Thus, when the first inflatable arch 224 and the second inflatable arch 226 are charged with air, the inflatable cross element 276 of the removable canopy 294 is simultaneously charged with air.

The removable canopy 294 also includes a forward canopy cover 278 and a rear canopy cover 280 as is clearly shown in FIG. 19. The forward canopy cover 278 is connected between the first inflatable arch 224 and the second inflatable arch 226, and is positioned over the front of the inflatable floating chamber 204 (i.e., forward of the inflatable cross element 276) as shown in FIG. 19. The rear canopy cover 280 is connected between the first inflatable arch 224 and the second inflatable arch 226, and is positioned over the rear of the inflatable floating chamber 204 (i.e., the back side of the inflatable cross element 276) as shown in FIG. 19. A second air inlet and exhaust valve 282 is mounted within the first inflatable arch 224 and is dedicated to the inflation of the first inflatable arch 224, second inflatable arch 226, and inflatable cross element 276 of the removable canopy 294 as is clearly shown in FIG. 19. Charging of the first inflatable arch 224, second inflatable arch 226, and inflatable cross element 276 simultaneously with air is possible since all three of these elements form a common air chamber.

Thus, the second air inlet and exhaust valve 282 functions as a situs for the admission and exhaust of air into the first inflatable arch 224, second inflatable arch 226, and inflatable cross element 276. It is noted that the second air inlet and exhaust valve 282 is identical in construction and operation to the first air inlet and exhaust valve 210 mounted in the bottom of the inflatable floating chamber 204. The second air inlet and exhaust valve 282 is comprised of polyvinylchloride material and is bonded to the polyvinylchloride sheeting of the first inflatable arch 224 as is known in the art, for example, by Radio Frequency (RF) welding. Air can be injected into the first inflatable arch 224, second inflatable arch 226, and inflatable cross element 276 at the second air inlet and exhaust valve 282 by any suitable air pump (not shown) or manually by the use of human lung power. Once inflated to an appropriate air pressure, a second tethered stop plug 284 is employed to seal the second air inlet and exhaust valve 282. Additionally, the second air inlet and exhaust valve 282 functions as a situs for the discharge of air from the first inflatable arch 224, second inflatable arch 226, and inflatable cross element 276. The pressurized air trapped therein can be ejected by removing the second tethered stop plug 284 from the second air inlet and exhaust valve 282. Hand pressure is then applied to the first inflatable arch 224, second inflatable arch 226, and inflatable cross element 276 until the trapped air is exhausted.

During operation of the inflatable flotation device 200 having the removable canopy 294 that is totally detachable from the inflatable floating chamber 204, the following procedure can be pursued. The removable canopy 294 is detachably removed from the inflatable floating chamber 204 by disconnecting the hook portions 242 of the first forward terminal end 228 and the first rear terminal end 230 of the first inflatable arch 224, and the hook portions 242 of the second forward terminal end 232 and the second rear terminal end 234 of the second inflatable arch 226, from the corresponding loop portions 238 of the hook and loop fasteners 240. It is to be emphasized that either (a) the first forward terminal end 228, or (b) first rear terminal end 230, or (c) second forward terminal end 232, or (d) second rear terminal end 234, or (e) each of the terminals ends 228, 230, 232, and 234 inclusive, or (f) any suitable combination of the terminal ends 228, 230, 232 and 234, can be removed from the inflatable floating chamber 204 to facilitate a partial or total removal of the canopy 294. Thus, at least one of the inflatable arches 224 or 226 having the (1) corresponding first forward terminal end 228 or first rear terminal end 230, and having the (2) corresponding second forward terminal end 232 or second rear terminal end 234, respectively, must be removed from the inflatable floating chamber 204 to facilitate entry into and exit from the bottom seat 216 of the inflatable floating chamber 204.

Thereafter, the inflatable floating chamber 204, inflatable back support 244, combination squeeze bar and whistle 250, and inflatable crossbar 260 can be charged with air at the first air inlet and exhaust valve 210 by use of a suitable pump (not shown). Next, the first inflatable arch 224, second inflatable arch 226, and inflatable cross element 276 of the removable canopy 294 can be charged with air at the second air inlet and exhaust valve 282. Thereafter, a person can be seated on the bottom seat 216 and the removed canopy 294 is repositioned over the inflatable floating chamber 204. In particular, the hook portions 242 of the hook and loop fasteners 240 are reattached to the corresponding loop portions 238 mounted on the top surface 206 of the inflatable floating chamber 204 consistent with those hook portions 242 that were initially disconnected. This is accomplished by reconnecting the hook portions 242 of the first forward terminal end 228 and the first rear terminal end 230 of the first inflatable arch 224, and the hook portions 242 of the second forward terminal end 232 and the second rear terminal end 234 of the second inflatable arch 226, to the corresponding loop portions 238 of the hook and loop fasteners 240. The procedure is then reversed to enable the person to exit the inflatable flotation device 200.

The present invention provides novel advantages over other flotation devices known in the prior art. A main advantage of the inflatable flotation device 100 used by persons in swimming or wading pools is that the canopy 102 positioned over the inflatable floating chamber 104 is removable. The removable canopy 102 facilitates the entry into and exit from the flotation device 100 by the person utilizing the flotation device 100. This feature greatly assists a person in accessing the bottom seat 116 of the flotation device 100 including a caretaker of children when utilizing flotation devices designed for use by children. Another advantage of the inflatable flotation device 100 is that the pair of inflatable arches 112 are attachable to and detachable from the inflatable floating chamber 104 via a plurality of hook and loop fasteners 140. This design provides for rapid removable of the pair of inflatable arches 112 from the inflatable floating chamber 104 and also for the rapid reuniting of the inflatable arches 112 with the inflatable floating chamber 104. Further advantages of the present invention include an inflatable back support 144 for supporting the back of the person, a bottom seat 116 for supporting the body weight of the person, and the combination squeeze bar and whistle 150 employed to distract and entertain a small child while seated in an inflatable flotation device 100 designed for use by children. Further, the inflatable flotation device 100 of the present invention is comprised of a lightweight, yet robust, polyvinylchloride tubular construction designed to hold air but yet avoid injury to any person utilizing the flotation device 100.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention.

Accordingly,

What is claimed is:

1. An inflatable flotation device for use by a person comprising:

an inflatable floating chamber for providing buoyancy in water;

a bottom seat affixed to said inflatable floating chamber for supporting a person, said bottom seat including a pair of penetrations formed therein for extending the legs of a person there through;

a pair of inflatable arches, said arches comprised of a first and second arch wherein the first inflatable arch includes a first forward terminal end removably attached to said floating chamber and a first rear terminal end permanently attached to said floating chamber and the second inflatable arch includes a second forward terminal end removably attached to said floating chamber and a second rear terminal end permanently attached to said floating chamber; and a canopy affixed to said inflatable arches.

2. The inflatable flotation device of claim 1 wherein each of said inflatable floating chamber, bottom seat, inflatable arches and canopy are comprised of polyvinylchloride.

3. The inflatable flotation device of claim 1 wherein said inflatable floating chamber includes an air inlet and exhaust valve.

4. The inflatable flotation device of claim 1 wherein said inflatable floating chamber further includes an inflatable back support for supporting said person.

5. The inflatable flotation device of claim 1 wherein said canopy includes an inflatable frame.

6. The inflatable flotation device of claim 1 wherein said canopy further includes an air inlet and exhaust valve.

7. The inflatable flotation device of claim 1 wherein a first common air path exists between said inflatable floating chamber and said first rear terminal end for inflating said first inflatable arch of said pair of inflatable arches.

8. The inflatable flotation device of claim 1 wherein a second common air path exists between said inflatable floating chamber and said second rear terminal end for inflating said second inflatable arch of said pair of inflatable arches.

9. The inflatable flotation device of claim 1 wherein said first forward terminal end of said first inflatable arch of said pair of inflatable arches is removably attached to said inflatable floating chamber with a first hook and loop fastener.

10. The inflatable flotation device of claim 1 wherein said second forward terminal end of said second inflatable arch of said pair of inflatable arches is removably attached to said inflatable floating chamber with a second hook and loop fastener.

11. The inflatable flotation device of claim 1 wherein there exists a common air path between both said first rear terminal end and said second rear terminal end of said inflatable arches and said inflatable floating chamber.

12. An inflatable flotation device for use by a person comprising:

an inflatable floating chamber for providing buoyancy in water;

a bottom seat affixed to said inflatable floating chamber for supporting a person, said bottom seat including a pair of penetrations formed therein for extending the legs of said person there through;

a pair of inflatable arches, said arches comprised of a first and second arch wherein the first inflatable arch includes a first forward terminal end removably attached with a pair of hook and loop fasteners to said floating chamber and a first rear terminal end permanently attached to said floating chamber and the second inflatable arch includes a second forward terminal end removably attached to said floating chamber with a pair of hook and loop fasteners and a second rear terminal end permanently attached to said floating chamber; and an inflatable canopy affixed to said inflatable arches.

13. An inflatable flotation device for use by a person comprising:

an inflatable floating chamber for providing buoyancy in water;

a bottom seat affixed to said inflatable floating chamber for supporting a person, said bottom seat including a pair of penetrations formed therein for extending the legs of said person there through;

a pair of inflatable arches, said arches comprised of a first and second arch wherein the first inflatable arch includes a first forward terminal end removably attached to said inflatable floating chamber and a first rear terminal end permanently attached to said floating chamber and the second inflatable arch includes a second forward terminal end removably attached to said floating chamber and a second rear terminal end permanently attached to said floating chamber; and an inflatable canopy affixed to said inflatable arches and comprising a plurality of separate air chambers.

14. The inflatable flotation device of claim 13 wherein said separate air chambers of said inflatable canopy comprise a plurality of horizontal air chambers.

15. An inflatable flotation device for use by a person comprising:

an inflatable floating chamber for providing buoyance in water;

a bottom seat affixed to said inflatable floating chamber for supporting a person, said bottom seat including a pair of penetrations formed therein for extending the legs of said person there through;

a pair of inflatable arches, said arches comprised of a first and second arch wherein the first inflatable arch includes a first forward terminal end removably attached to said floating chamber and a first rear terminal end permanently attached to said floating chamber and the second inflatable arch includes a second forward terminal end removably attached to said floating chamber and a second rear terminal end permanently attached to said floating chamber;

a canopy affixed to said inflatable arches; and means for entertaining a person, affixed to said inflatable flotation device.

16. The inflatable flotation device of claim 15 wherein said means for entertaining a person consists of a combination squeeze bar and whistle.

* * * * *